United States Patent [19]

Early

[11] 4,369,481

[45] Jan. 18, 1983

[54] ELECTRONIC LOCK

[76] Inventor: David Early, Box 1102, Bridgeport, Tex. 76026

[21] Appl. No.: 143,437

[22] Filed: Apr. 24, 1980

[51] Int. Cl.[3] ..... H01H 47/00

[52] U.S. Cl. ..... 361/173; 361/172; 70/DIG. 51

[58] Field of Search ..... 361/172, 173, 176, 177; 70/DIG. 51; 340/149 A

[56] References Cited

U.S. PATENT DOCUMENTS

| | | | |
|---|---|---|---|
| 3,564,500 | 2/1971 | Cook | 361/176 X |
| 3,769,514 | 10/1973 | Clark, Jr. | 361/176 |
| 3,896,345 | 7/1975 | Zink | 361/176 X |
| 4,091,271 | 5/1978 | Jones et al. | 361/172 |

OTHER PUBLICATIONS

Mestre, A. F., "Switching Circuit Employing Photo-Diodes," *IBM Tech. Disclosure Bulletin,* vol. 3, No. 1, Jun. 1960.

*Primary Examiner*—J. D. Miller
*Assistant Examiner*—L. C. Schroeder
*Attorney, Agent, or Firm*—Arthur F. Zobal

[57] ABSTRACT

A lock comprising a laser adapted to emit a beam of light along a given path. A plurality of photo-diodes are electrically connected together and located at spaced apart positions defining a unique pattern. A key having a light reflecting means is adapted to be located in the path of the laser beam. The reflecting means when located in the laser beam path reflects light back to the photo-diodes in the unique pattern to cause the lock to be unlocked. In another embodiment, the photo-diodes are located in an array which is scanned to determine if light is reflected from the reflecting means of the key in a unique pattern.

12 Claims, 4 Drawing Figures

ELECTRONIC LOCK

FIELD OF THE INVENTION

The present invention relates to an electronic lock.

SUMMARY OF THE INVENTION

It is an object of the present invention to provide a new and useful electronic lock comprising means for producing a beam of electromagnetic radiation, a key having a reflecting means for reflecting the beam in a unique pattern and electromagnetic radiation sensitive means responsive to the beam when reflected in the unique pattern for causing the lock to be unlocked.

In the embodiment disclosed, the beam produced is a laser beam, and the electromagnetic radiation sensitive means comprises a plurality of light sensitive means located to receive the beam reflected in the unique pattern.

DESCRIPTION OF THE PREFERRED EMBODIMENTS

Figure 1:
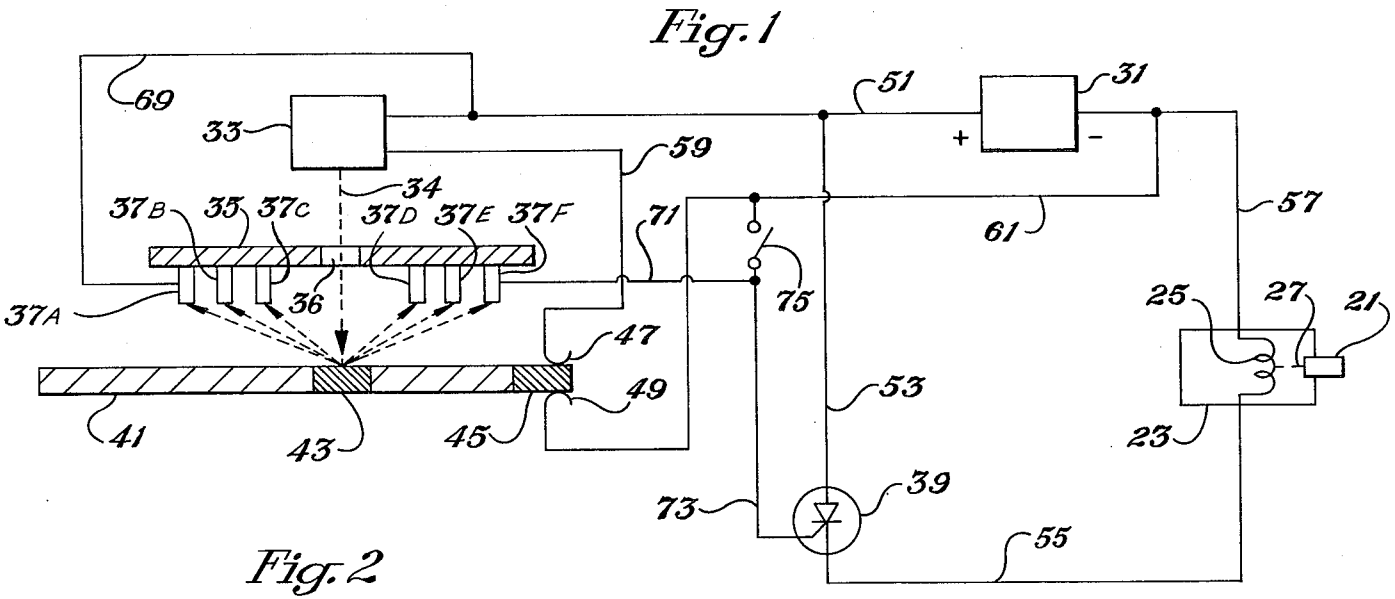
FIG. 1 is a schematic illustration of the invention.
Figure 3:
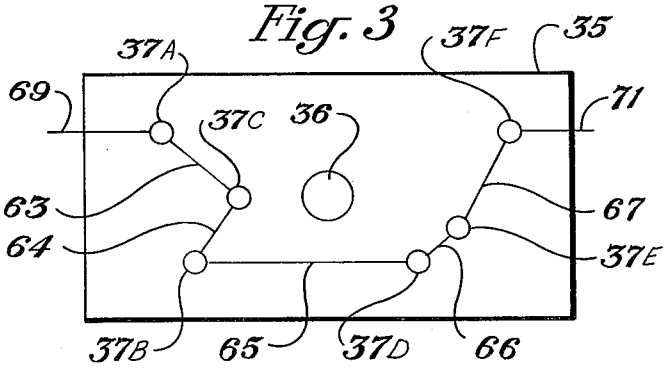
FIG. 3 is a plan view of the light sensor board of FIG. 1.
Figure 2:
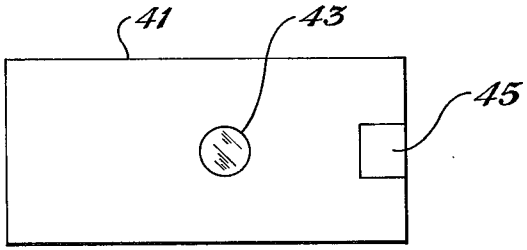
FIG. 2 is a plan view of the key employed in the system of FIG. 1.

Referring now to FIGS. 1-3, the lock comprises an electric door strike 21 movable by a solenoid 23. The solenoid 23 comprises an electrical coil 25 having a core 27 connected to the strike 21. When the solenoid 23 is energized, it moves the strike 21 to an "unlatched" position to move the latch of a door (not shown) out of the jamb and permits the door to be opened. The latch is part of a door knob mechanism in which the knob can be turned only from one side, the side located in the security area. This allows the person in the security area to leave the area without operating the lock.

Reference numeral 31 identifies a D.C. power supply and reference numeral 33 identifies a laser capable of emitting a beam of light 34 along a given path when energized. Reference numeral 35 identifies a sensor board which carries a plurality of photo-diodes 37A-37F. The board 35 has a hole 36 formed therethrough to allow passage of the beam 34. Member 39 is a silicon controlled rectifier (SCR). Member 41 is a removable key which carries a light reflecting means 43 and an electrically conductive member 45 the latter of which is adapted to engage electrical contacts 47 and 49 when the key is located in the position shown.

The power supply 31 has its plus terminal connected to the laser 33 by way of lead 51. The anode of the SCR 39 is connected to lead 51 by way of lead 53 and the cathode of SCR 39 is connected to one terminal of solenoid 23 by way of lead 55. The other terminal of solenoid 23 is connected to the minus terminal of supply 31 by way of lead 57. The other terminal of the laser 33 is connected to contact 47 by way of lead 59 and contact 49 is connected to lead 57 by way of lead 61.

The photo-diodes 37A-37F are secured to board 35 at spaced apart positions and are located in a unique pattern. The diodes are all electrically connected together in series by way of leads 63-67. Diode 37A is connected to lead 51 by way of lead 69 and diode 37F is connected to the gate of SCR 39 by way of leads 71 and 73. A switch 75 is connected between leads 71, 73 and lead 61.

Strike 21, solenoid 23, power supply 31, laser 33, board 35, contacts 47 and 49, SCR 39 and switch 75 all are carried by the house or building structure. The strike 21 and solenoid 23 is located in the wall adjacent the door. The laser 33, board 35 and contacts 47 and 49 will be carried by the wall of the house or building and positioned on the exterior to allow them to function as will be described. Power supply 31, SCR 39 and switch 75 will be located in the security area of the house or building. Normally the switch 75 will be open and SCR 39 will be a nonconducting condition. The key 41 is removable and normally will be carried by the user. In use the key 41 will be located as shown such that the electrically conductive member 45 engages contacts 47 and 49. Although not shown, guides will be provided to allow the key 41 to be positioned as shown. When member 45 engages contacts 47 and 49 a circuit is completed to the laser turning it on and causing it to emit a beam 34. The beam passes through aperture 36 of board 35 and strikes light reflecting means 43. Reflecting means 43 preferably is a crystallized substance such as diamond, corundum, etc. The crystal 43 reflects light back in a unique light pattern consisting of several major points of light and many minor points of light. The crystal employed reflects the major points of light in a unique pattern corresponding to the pattern of the diodes as secured to board 35. If the key is the proper one for the lock, each photo-diode will coincide in position with a major point of reflected light. Thus all of the photo-diodes will conduct and current will be applied from the supply 31 to the gate of the SCR 39 by way of the chain of photo-diodes and cause the SCR to conduct. This completes a circuit to the solenoid 23 which moves the strike 21 to the "unlatched" position allowing the door to be opened. The completed circuit is by way of leads 51 and 53, SCR 39, lead 55, solenoid 23 and lead 57. The key may be removed to remove member 45 out of engagement of contacts 47 and 49. The SCR will continue to conduct holding the strike 21 in an unlatched position. When the door is closed it may be locked by closing switch 75. This deactivates the SCR 39 which deenergizes solenoid 23 and allows the strike 21 to move to a latched position whereby the latch of the door is held in place. When it is necessary for a person in the security area to exit through the door, he simply opens the door by turning the door knob on the security side as he would on any other door.

If the key employed is not made for the lock, then at some point along the chain of photo-diodes one or more will not have light falling on it and it will have a high resistance. This will prevent the flow of current through the chain of photo-diodes whereby the SCR 39 will not conduct and the strike 21 will not be unlatched.

Although the reflecting means 43 was described as a crystal it is to be understood it could be made up of a plurality of small mirrors positioned to reflect light in the unique pattern as defined by the positions of the photo-diodes 37A-37F. The reflecting means 43 also could be made of many small light reflecting flakes embedded in plastic and which would reflect light in a unique pattern.

Figure 4:
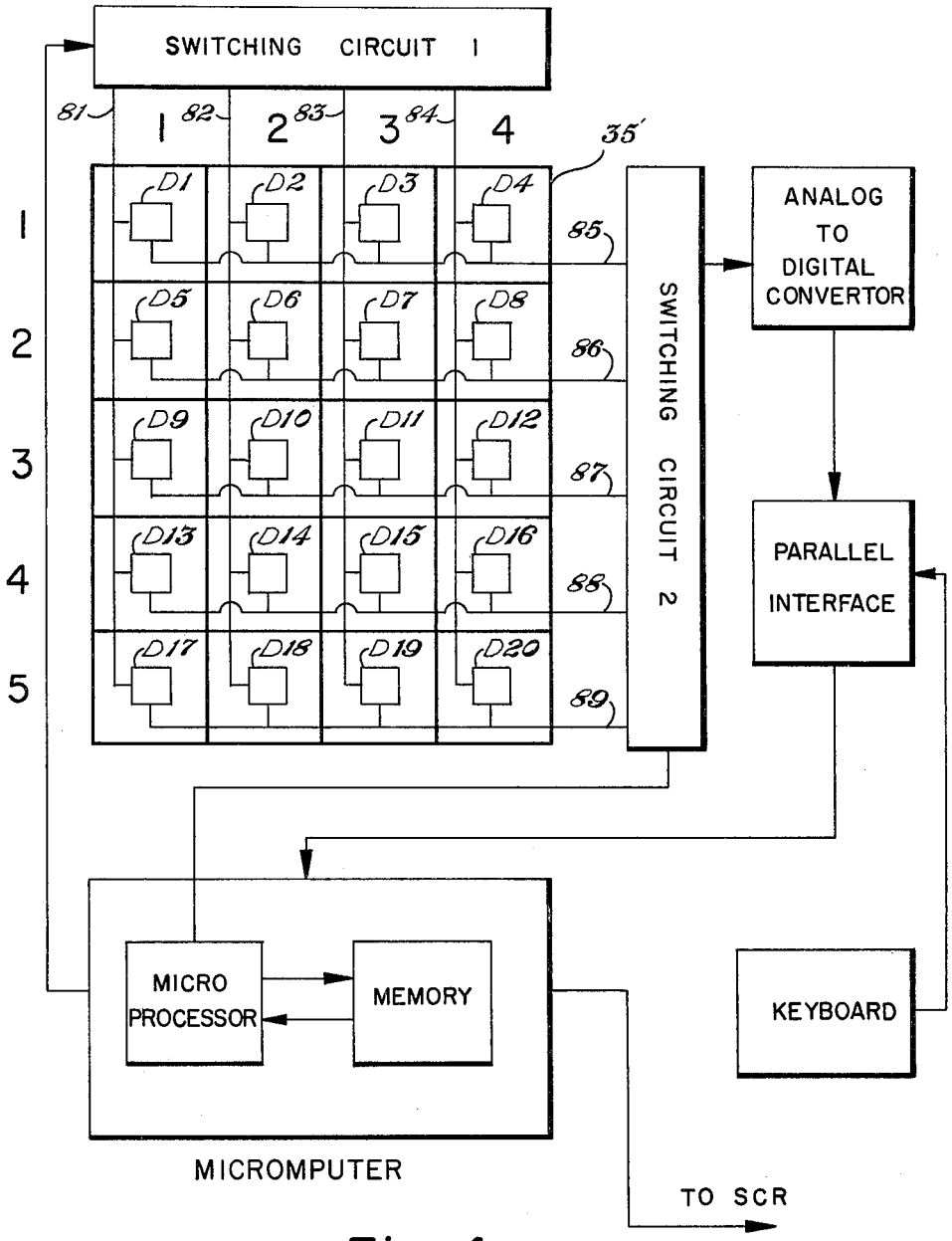
FIG. 4 illustrates another embodiment of the present invention.

Referring now to FIG. 4, the lock comprises a board 35' having an arrow of photo-diodes. In the board of FIG. 4, the array comprises five rows of photo-diodes with each row having four photo-diodes. The photo-diodes are identified as D1–D20. Switching circuits 1 and 2 are electrically connected to each of the photo-diodes by way of leads 81–89. Also provided are a microcomputer comprising a microprocessor and memory, an analog to digital circuit, a parallel interface, and a keyboard. The lock also comprises the strike 21, solenoid 23, power supply 31, laser 33, key 41, contacts 47 and 49, switch 75 and SCR 39. Leads 69 and 71 will not be employed. The rest of the circuitry will be as shown in FIG. 1, with the output of the microcomputer connected to the gate of the SCR 39. The board 35' does not have the aperture 36 and will be located to the side of the laser beam 34.

In use, the key 41 will be positioned such that member 45 engages contacts 47 and 49 to turn on the laser 33. The reflecting means 43 will be positioned such that it will reflect the beam 34 as points of light in a unique pattern on the diodes on the board 35'. The board 35' will be scanned by the system and the binary code which is produced is compared with a code stored in the memory. The areas which receive little or no reflected light from the reflecting means 43 produce a very low voltage current which causes the analog to digital converter to produce a smaller number. The lighted areas create a larger number. As the processor scans each column of the board, it will then proceed to compare the code with those stored in its memory. If the code for a column matches one stored in memory, then the system proceeds to the next column. If the codes of all of the columns of board 35' are matched with those stored in memory, the system applies an output to activate the SCR 39 to release the door latch. If the code for one of the columns is not matched with a code stored in memory, then the SCR will not be activated and the lock will not release the door latch.

In a more detailed description of the operation, the lock will go through a number of processes. First, the key is inserted into the lock which turns it on as described above. An interrupt signal is sent to the microprocessor to inform it that a key has been inserted. As soon as the processor has finished with the current task it is performing, it goes to the memory location where instructions and data for the lock are stored. Next it waits for the person operating the lock to punch in a number which identifies his key. Upon receiving the number, the processor sends a signal to the switching circuit 1 which causes it to supply a small current to the first column of photo-diodes. The second switching device then allows the current from the first photo-diode in row one to be applied to the input of the analog to digital converter which then generates a digital output. The output travels through the parallel interface to the microprocessor which compares the number with the first number stored in its memory for that key. If the numbers match up, then the processor instructs the switching circuit 2 to allow the current from the first photo-diode in the second row to go to the analog to digital converter. The process then continues as it did for the first photo-diode and the resulting number is compared with the second number in the computer's memory, etc. When the last photo-diode in column one has been read then the processor causes the switching circuit 1 to now supply current to the second column of the photo-diodes and the process continues until the last photo-diode in row five has been read. If all the numbers in the memory match up with those supplied by sampling the photo-diode, the computer opens the lock.

With this system, it is possible to have many different keys for one lock, as many as the memory space will allow. The codes for the different keys will be stored in different sections of the memory.

Since each key could be given a number which corresponds to a section in the memory, it would be possible to delete a key's code from memory if it were lost or stolen. If new keys were desired, it would be a simple operation to add their codes to the lock's memory. This could be done by inserting a new key in the lock and allow the system to scan the crystal's light pattern as reflected on the board 35' and store it in its memory.

The electric door strike comprising strike 21 and solenoid 23 is a commercially available device.

In the embodiment of FIG. 4, the light sensitive devices were referred to as photo-diodes, however, they could be any type of photo-sensitive devices which could change the voltage of the current going to the analog to digital converter. Such means as photo-resistive devices could be used.

I claim:

1. A lock comprising:

a movable member for releasing a door, solenoid means for moving said member to a position to allow the door to be opened when said solenoid means is energized, a laser located to emit a beam of electromagnetic radiation along a give path, a key having a reflecting means adapted to be located in the path of said beam to reflect electromagnetic radiation from said beam in a given pattern, a plurality of electromagnetic radiation sensitive means for receiving reflected electromagnetic radiation from said reflecting means in said given pattern, means responsive to said plurality of electromagnetic radiation sensitive means when they receive electromagnetic radiation in said given pattern for coupling a source of electrical power to said solenoid means for energizing said solenoid means.

2. The lock of claim 1, wherein:

said plurality of electromagnetic radiation sensitive means comprise a plurality of photo-diodes.

3. The lock of claim 1, wherein:

said reflecting means comprises a crystallized means.

4. The lock of claim 1, wherein:

said plurality of electromagnetic radiation sensitive means comprise a plurality of photo-diodes, said reflecting means comprises a crystallized means.

5. A lock, comprising:

a source of electrical power, a movable member for releasing a door, solenoid means for moving said member to a position to allow the door to be opened when said solenoid means is energized, control means coupled to said source of power and to one terminal of said solenoid means, the other terminal of said solenoid means being coupled to said source of electrical power, a source of light located to emit a beam of light along a given path, a pair of electrical contacts, said source of light having one terminal coupled to said source of power and another terminal coupled to one of said contacts of said pair of contacts, the other contact of said pair of contacts being coupled to said source of power, a key having a reflecting means adapted to be located in the path of the light beam to reflect light from said light beam in a given pattern, said key comprising conductive means for completing an electrical circuit between said pair of contacts when said key is positioned to locate said reflecting means in said path to allow said source of light to be energized to produce a beam of light along said path, and light sensitive means coupled to said source of power and to said control means, said light sensitive means allowing electrical current to flow from said source of power to said control means to activate said control means when reflected light from said light beam impinges on said light sensitive means in said given pattern, said control means when activated allowing current to flow from said source of power to said solenoid means for energizing said solenoid means.

6. The lock of claim 5, wherein:

said light sensitive means comprises a plurality of spaced apart photo-diodes located in said given pattern and electrically coupled together in series, said series of photo-diodes comprising a first photo-diode at one end of said series and a last photo-diode at the other end of said series, said first photo-diode being coupled to said source of power and said last photo-diode being coupled to said control means.

7. The lock of claims 5 or 6, wherein:

said reflecting means comprises a crystallized means.

8. The lock of claims 5 or 6, wherein:

said source of light comprises a laser.

9. The lock of claims 5 or 6, wherein:

said reflecting means comprises a crystallized means, said source of light comprises a laser.

10. A lock comprising:

a movable member for releasing a door, solenoid means for moving said member to a position to allow the door to be opened when said solenoid means is energized, a source located to emit a beam of electromagnetic radiation along a given path, a key having a reflecting means adapted to be located in the path of said beam to reflect electromagnetic radiation from said beam in a given pattern, a plurality of electromagnetic radiation sensitive means for receiving reflected electromagnetic radiation from said reflecting means in said given pattern, means responsive to said plurality of electromagnetic radiation sensitive means when they receive electromagnetic radiation in said given pattern for coupling a source of electrical power to said solenoid means for energizing said solenoid means, said plurality of electromagnetic radiation sensitive means comprising a plurality of photo-diodes.

11. A lock comprising:

a movable member for releasing a door, solenoid means for moving said member to a position to allow the door to be opened when said solenoid means is energized, a source located to emit a beam of electromagnetic radiation along a given path, a key having a crystallized reflecting means adapted to be located in the path of said beam to reflect electromagnetic radiation from said beam in a given pattern, a plurality of electromagnetic radiation sensitive means for receiving reflected electromagnetic radiation from said crystallized reflecting means in said given pattern, means responsive to said plurality of electromagnetic radiation sensitive means when they receive electromagnetic radiation in said given pattern for coupling a source of electrical power to said solenoid means for energizing said solenoid means.

12. A lock comprising:

a movable member for releasing a door, solenoid means for moving said member to a position to allow the door to be opened when said solenoid means is energized, a source located to emit a beam of electromagnetic radiation along a given path, a key having a crystallized reflecting means adapted to be located in the path of said beam to reflect electromagnetic radiation from said beam in a given pattern, a plurality of electromagnetic radiation sensitive means for receiving reflected electromagnetic radiation from said crystallized reflecting means in said given pattern, means responsive to said plurality of electromagnetic radiation sensitive means when they receive electromagnetic radiation in said given pattern for coupling a source of electrical power to said solenoid means for energizing said solenoid means, said plurality of electromagnetic radiation sensitive means comprising a plurality of photo-diodes.

* * * * *